US007881867B2

(12) United States Patent
Lorido et al.

(10) Patent No.: US 7,881,867 B2
(45) Date of Patent: Feb. 1, 2011

(54) ONBOARD SYSTEM FOR THE PREVENTION OF COLLISIONS OF AN AIRCRAFT WITH THE GROUND WITH END-OF-CONFLICT INDICATION

(75) Inventors: Didier Lorido, Plaisance du Touch (FR); Nicolas Marty, Saint Sauveur (FR); Philippe Salmon, Colomiers (FR)

(73) Assignee: Thales (FR)

( * ) Notice: Subject to any disclaimer, the term of this patent is extended or adjusted under 35 U.S.C. 154(b) by 999 days.

(21) Appl. No.: 11/683,989

(22) Filed: Mar. 8, 2007

(65) Prior Publication Data

US 2010/0274486 A1 Oct. 28, 2010

(30) Foreign Application Priority Data

Mar. 8, 2006 (FR) ..... 06 02069

(51) Int. Cl.
*G08G 5/04* (2006.01)

(52) U.S. Cl. ..... 701/301; 701/9; 701/7; 701/3; 340/995.1

(58) Field of Classification Search ..... 701/301, 701/9, 7, 3; 340/961, 963, 964, 967, 974, 340/975, 995.1
See application file for complete search history.

(56) References Cited

U.S. PATENT DOCUMENTS 5,488,563 A * 1/1996 Chazelle et al. ..... 701/301
5,683,282 A * 11/1997 Liu et al. ..... 445/50
5,706,011 A 1/1998 Huss et al.
6,317,663 B1 * 11/2001 Meunier et al. ..... 701/16
6,317,690 B1 * 11/2001 Gia ..... 701/301
6,683,541 B2 * 1/2004 Staggs et al. ..... 340/961
7,295,134 B2 * 11/2007 Jourdan et al. ..... 340/963

FOREIGN PATENT DOCUMENTS

FR 2 848 661 A1 6/2004
WO 2004/059445 A2 7/2004
WO 2004059445 A2 7/2004

* cited by examiner

*Primary Examiner*—Thomas G Black
*Assistant Examiner*—Marthe Marc Coleman
(74) *Attorney, Agent, or Firm*—Lowe Hauptman Ham & Berner, LLP

(57) ABSTRACT

The TAWS system, in addition to an FTLA function for detecting the risk of collision with the terrain, has an end-of-conflict announcement function COT which is activated after the cessation of a warning or alarm concerning the risk of collision with the ground originating from the FTLA function. This COT function, when activated, checks that the aircraft (A) is observing minimum vertical and lateral safe distances, and estimates the lower vertical speed margin with which a new ground collision risk warning will not be retriggered. After confirming the observance of the minimum safe distances, the COT function has an end-of-conflict message ("Clear of terrain") sent with a lower vertical speed margin indication.

10 Claims, 6 Drawing Sheets

ONBOARD SYSTEM FOR THE PREVENTION OF COLLISIONS OF AN AIRCRAFT WITH THE GROUND WITH END-OF-CONFLICT INDICATION

RELATED APPLICATIONS

The present application is based on, and claims priority from, FRANCE Application Number 06 02069, filed Mar. 8, 2006, the disclosure of which is hereby incorporated by reference herein in its entirety.

FIELD OF THE INVENTION

The present invention relates to the indication, on board an aircraft, of the end of a conflict with the terrain having provoked a warning or an alarm from an onboard system indicating risks of collision with the terrain known by the acronym TAWS ("Terrain Awareness & Warning Systems").

BACKGROUND OF THE INVENTION

The onboard TAWS systems on board aircraft are responsible for the prevention of aeronautical accidents in which an aircraft that is still maneuverable crashes. Accidents of this type, known in the technical literature by the acronym CFIT, standing for "Controlled Flight Into Terrain", in the past constituted a significant percentage of air disasters. They are now mostly avoided, thanks to terrain avoidance maneuvers performed by the crews driven by warnings and alarms originating from TAWS systems, included in which are the GCAS (Ground Collision Avoidance System) and T2CAS (Terrain & Traffic Collision Avoidance System) systems, developed and marketed by Thales.

The TAWS systems use a so-called FLTA (Forward Looking Terrain Avoidance) function which watches, in front of the aircraft, along and below its flight path vertically and laterally, to see if there is a potential risk of collision with the terrain. Their principle is based on monitoring the penetration of the terrain into one or more protection volumes linked to the aircraft based on a modeling of the terrain being flown over and on the warnings and alarms issued each time the terrain penetrates into a protection volume.

The problem posed by the TAWS systems is that the end of a warning or an alarm is an indication of the effectiveness of the avoidance maneuver undertaken, but not of the end of the conflict with the terrain which occurs only when the aircraft can resume a normal flight.

In the absence of "end of conflict with the terrain" signal, the crew of an aircraft waits until it is clearly above a safe altitude to terminate a terrain avoidance maneuver undertaken following a warning or alarm originating from a TAWS system, which unnecessarily prolongs the flight time.

To resolve this problem, the applicant has already proposed, in French Patent Publication No. FR 2.848.661, a TAWS system using, in addition to the protection volumes linked to the aircraft and configured for the detection of the risks of collision with the terrain, an additional protection volume linked to the aircraft, especially configured to detect the moment when the aircraft has the possibility of terminating the avoidance maneuver to fly horizontally or resume the bearing and gradient followed prior to the avoidance maneuver. This additional route resumption protection volume is defined, like the other protection volumes, by its lower and front part which serves as a sensor and must not come into contact or, a fortiori, penetrate into the terrain for there to be the possibility of terminating an avoidance maneuver.

After a successful terrain avoidance maneuver, the crew of the aircraft can return to the path provided in its flight plan because, in practice, when a TAWS system issues a justified alarm, the aircraft is no longer on the path provided in its flight plan. With the end of conflict with the ground signal delivered by the abovementioned TAWS system, the crew has, depending on the configuration adopted for the additional route resumption protection volume, either the possibility of resuming a horizontal flight but with no guarantee of freedom of maneuver in the horizontal plane or information on its lower vertical speed margin, or the possibility of resuming the bearing and the gradient followed prior to the avoidance maneuver, which may not be sufficient to return to the path initially provided when the risk of collision with the ground that has been avoided is the consequence of a lateral path error.

SUMMARY OF THE INVENTION

It is an object of the present invention is to overcome the abovementioned drawbacks by providing the crew of an aircraft with an end of conflict with the ground signal guaranteeing freedom of maneuver laterally and vertically and informing the crew on the lower vertical speed margin to be observed so as not to retrigger a conflict with the terrain warning or alarm.

The subject of the invention is an onboard system for the prevention of collisions of an aircraft with the ground comprising: a detector of risk of collision with the terrain by comparing a risk of collision of the aircraft with the terrain within a predetermined prediction period, with the penetration of a topographic representation of the terrain being flown over generated from cartographic data stored in a database accessible from the aircraft, into at least one maneuver protection volume linked to the aircraft, located relative to the terrain being flown over by means of a locating device that is on board and oriented in the direction of movement of the aircraft, and a message generator generating warnings on request from the collision risk detector. This onboard system is noteworthy in that it also comprises:

- means of checking that the aircraft is observing minimum safe distances from the terrain being flown over,
- means of determining a lower vertical speed margin implementing an additional vertical speed margin protection volume, linked to the aircraft, with a lower longitudinal profile beginning, on the aircraft side, with a path extrapolated from the current path of the aircraft tilted downward, until the topographic representation of the terrain being flown over penetrates into the additional vertical speed margin protection volume, and comparing the angular tilt amplitude found with the lower vertical speed margin, and
- means of triggering the message generator requiring the message generator to send an end of conflict with the ground message, with lower vertical speed margin indication, after an end of triggering of the ground collision risk detector and confirmation by the checking means that the aircraft is observing minimum safety distances.

Advantageously, the minimum safe distances in the vertical plane considered by the checking means depend on the flight phase of the aircraft, defined as a function of its flight level, its speed and its distance to an airport.

Advantageously, the checking means take account of the current position of the aircraft and its positions in a near future deduced from a path extrapolation created from the flight parameters.

Advantageously, the checking means comprise a minimum vertical margin detector sensitive to the penetration of the topographic representation of the terrain being flown over into an additional vertical margin protection volume linked to the aircraft and having a lower surface profile modeling a potential leveling-off path initiated from the current position of the aircraft assumed to be engaged in a steep descent close to the limit allowed in normal operating conditions.

Advantageously, the minimum safe distances in the horizontal plane, considered by the checking means, take account of the lateral distances needed for the aircraft to describe a holding pattern.

Advantageously, the additional vertical speed margin protection volume has, initially, the same configuration as a maneuver protection volume.

Advantageously, the additional vertical speed margin protection volume comprises a maneuver protection volume progressively tilted overall downward.

Advantageously, the additional vertical speed margin protection volume has its lower longitudinal profile tilted downward, in successive steps and in a dichotomic manner, until it is penetrated by the topographic representation of the terrain being flown over.

Other characteristics and advantages of the invention will become apparent from the following description of an embodiment given by way of example. This description is given in light of the drawing in which:

DETAILED DESCRIPTION OF THE EMBODIMENTS

Figure 1:
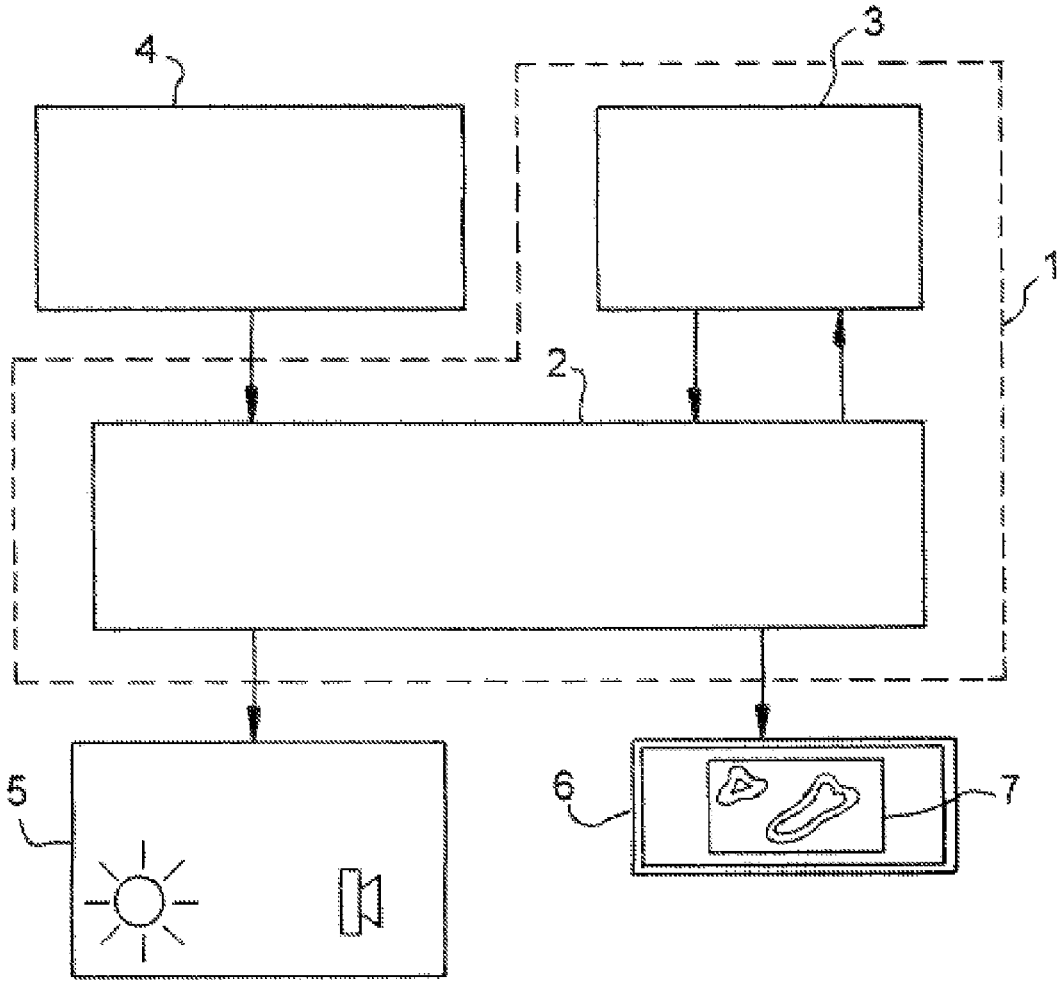
FIG. 1 is a theoretical diagram of an onboard terrain collision avoidance system on board an aircraft.

FIG. 1 shows an onboard terrain collision avoidance system 1 in its functional environment on board an aircraft. The latter mainly comprises a computer 2 associated with a database 3 containing, among other things, cartographic data and performance data concerning the aircraft.

The cartographic part of the database 3 stores sets of terrain elevation values and safe altitude set points corresponding to samplings, by one or more geographic locating grids, of the points of a more or less extensive maneuver region.

The performance part of the database 3 contains the information needed to establish the performance characteristics of the moment of the aircraft and, in particular, its climb capability.

The computer 2 can be a computer dedicated to the terrain avoidance equipment or a computer shared with other tasks such as flight management or the automatic pilot. Regarding the terrain avoidance equipment, it receives from the navigation instruments 4 of the aircraft, the main flight parameters, including the position of the aircraft in latitude, longitude and altitude, and the direction and the modulus of its speed vector. Based on these flight parameters, it assumes the FLTA function of detecting risks of collision with the terrain by carrying out the following operations:

- delimiting, in the maneuver region covered by the cartographic part of the database 3, an area being flown over within range of the aircraft over a period greater than the warning time sought,
- generating, from elevation values of the points of this area being flown over stored in the cartographic part of the database 3, of a topographic representation of the relief and/or of the obstacles on the ground present in this area being flown over or rather an MTCD (Minimum Terrain Clearance Distance) area covering the relief and/or the obstacles of the area being flown over and taking account of a minimum vertical safety margin originating from the inaccuracies in the cartographic data in the database 3 and the knowledge of the geographic position of the aircraft,
- determining, at each instant, based on information originating from the flight instruments and from the performance part of the database 3, at least two maneuver protection volumes that are included in each other and directed towards the front and below the aircraft, and which must not come into contact with the terrain or the obstacles on the ground being flown over,
- comparing the respective elevations of the points of the envelopes of the maneuver protection volumes with those of the points of the MTCD surface at the level of their samplings by the geographic locating grid used in the database 3 to detect any intrusion of the MTCD surface into the maneuver protection volumes, and
- each time an intrusion is detected, using a message generator 5 to issue a "Caution" warning when the greatest of the maneuver protection volumes is touched and a "Pull-up" or "Avoid Terrain" alarm if the smallest maneuver protection volume is also touched.

Moreover, to facilitate the evaluation and resolution of the risks of collision with the terrain, by the crew of the aircraft, the computer 2 displays on a screen 6 a map of the terrain being flown over showing the threatening areas of terrain. This two-dimensional map is made up of a representation by contour lines 7, of the terrain being flown over with false colors showing the scale of the risk of collision corresponding to each slice.

A maneuver protection volume linked to the aircraft delimits a part of the space in which the aircraft needs to be able to maneuver in a more or less near future without risk of collision with the terrain. Its size and its shape depend on the delay sought between the issuing of a warning or alarm and the realization of the corresponding risk of collision with the terrain, and the maneuverability of the aircraft at the moment concerned, that is, the maneuver capabilities of the aircraft that are linked to its performance characteristics of the moment, the modulus and the direction of its air speed, and its flight attitude (flying in a straight line or turning, etc.). It is defined by a virtual envelope with no physical reality, of which only the lower and front parts are considered because they are the only possible pathways of penetration into the protection volume, for the terrain or obstacles on the ground.

The lower and front parts of the envelope of a maneuver protection volume are normally likened to a strip, with a horizontal transverse axis along, with a certain vertical offset, the path that would be followed by the aircraft if its crew had been warned of a risk of collision with the terrain and would have made it adopt, after a normal response time plus a shorter or longer safety margin, a climbing avoidance path, with a gradient close to the maximum of its capabilities of the moment. This strip, with a horizontal transverse axis, starts from below the aircraft, at a vertical distance corresponding to a safety margin to be observed for the aircraft with respect to the ground. It extends, widening to take account of the increasingly great uncertainty concerning the predictable position of the aircraft as the prediction time increases. It begins by being directed in the current direction of movement of the aircraft, then curves upward until it adopts a climb gradient corresponding to the maximum of the climb capabilities of the aircraft. In practice, this strip with transverse horizontal axis has a longitudinal profile corresponding to that of a potential path comprising in its first part an extrapolation of the path followed by the aircraft, predicted based on flight information, delivered by the flight instruments 4 of the aircraft and information from the performance part of the database 3, in the second part a climbing avoidance maneuver path with a gradient close to the maximum of the capabilities of the moment, undertaken over the prediction time, and, between the two parts, a transition path corresponding to a cancellation of the roll angle with a speed at most typically 15°/s and with an assumed pitch angle corresponding to a load factor of 0.5 g for example, until a climb gradient corresponding to the climb capabilities of the moment of the aircraft is obtained.

This strip with horizontal transverse axis serves as a sensor because it is its violation by the MTCD surface covering the relief and/or the obstacles on the ground that act as a criterion for deciding on penetration of the terrain or obstacles on the ground into the maneuver protection volume and accepting the existence of a risk of collision.

Figure 2:
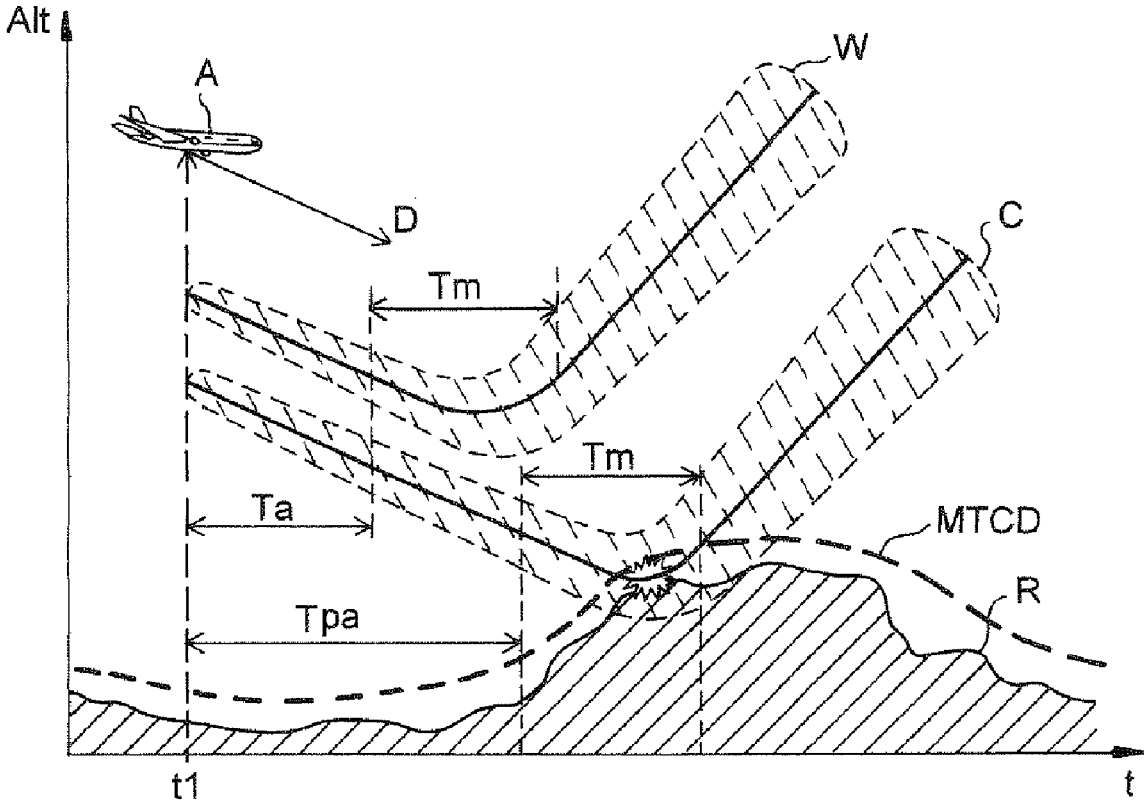
FIGS. 2 and 3 are views, mainly in the vertical plane, showing the two main phases of a terrain avoidance, sequence: the warning phase and the conflict resolution phase.

In FIG. 2, an aircraft A is moving, in descent, at an instant t1 and in a direction D, over a terrain of vertical profile R. This aircraft A is provided with a terrain avoidance device that implements two maneuver protection volumes included in each other: a large protection volume that is used for warnings indicating to the crew that the path followed must be modified in the short term to avoid the terrain and that corresponds to a first warning sensor C, and a small protection volume that is used for alarms indicating to the crew of the aircraft that it must actually, and urgently, undertake an avoidance maneuver and that corresponds to a second alarm sensor W. The two sensors C and W used for the warnings and the alarms model avoidances of the relief from above, begun at instants t1+Tpa and t1+Ta and requiring an implementation time Tm. The detection of the short term risks of collision with the terrain for a warning entails predicting the avoidance maneuver from above after a delay that is longer than the detection in the very short term, of the risks of collision with the terrain for an alarm, which is reflected by an offset of the sensor C relative to the sensor W along the time axis, in the direction of the future. Since it relies on a longer term prediction of the position of the aircraft, it is less reliable. For it nevertheless to retain the same detection dependability, its sensor C is also offset downward relative to the sensor W.

Figure 3:
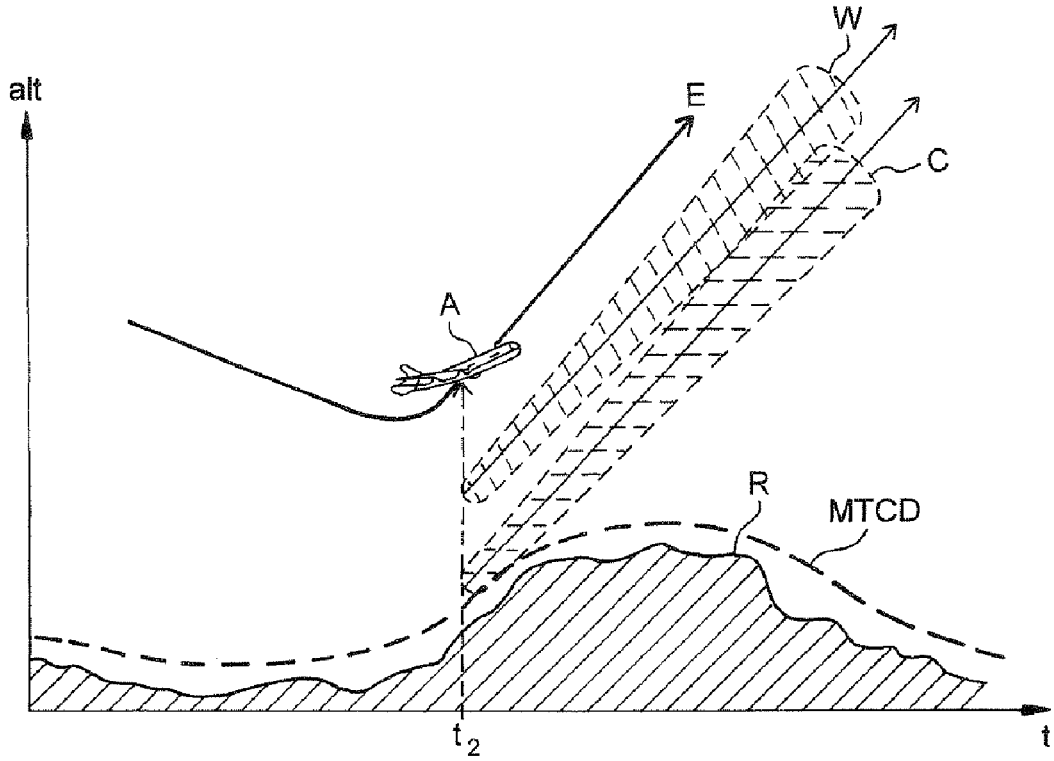

FIG. 3 shows the situation of the aircraft A at a subsequent instant t2 when it begins a climb in the direction E to eliminate an indicated risk of collision with the terrain. The sensors C and W have taken the new climb direction E of the aircraft A and are straightened since the aircraft A is close to the maximum of its climb capabilities. They no longer encounter the terrain R and the MTCD surface that covers it, so the terrain avoidance system of the aircraft A no longer issues either a warning or an alarm. The fact that the warning and alarm concerning the risk of collision with the terrain are stopped informs the crew of the good effectiveness of the current avoidance maneuver from above but does not inform it as to the possibility or otherwise of resuming the descent path that it was following before the advent of the terrain collision warning that it has just dealt with.

To overcome this lack of information, the computer 2 of the terrain avoidance system is provided, in addition with the FLTA function for detecting risks of collision with the terrain, an additional COT (Clear Of Terrain) function announcing the end of conflict with the terrain. This COT function, activated after each cessation of a warning or alarm concerning the risk of collision with the terrain, provokes the issue, by the message generator 5, of a "Clear of Terrain" end-of-conflict message accompanied by a lower vertical speed margin indication, when the aircraft once again checks minimum safe distances relative to the terrain being flown over.

The minimum safe distances relative to the terrain checked by the end-of-conflict announcement function COT can concern: a minimum safe altitude when it is possible to determine one, a minimum maneuver margin in the vertical plane and a minimum maneuver margin in the horizontal plane.

The minimum safe altitude taken into consideration refers to the geographic point being flown over, whether it is at the instant or in a near future. It is extracted:

- from the minimum regulatory altitudes MSA (standing for Minimum Safe Altitude) imposed by the state authorities in geographic sectors near to airports or on the segments of the navigation procedures approaching a landing field,
- minimum regulatory altitudes MEA (standing for Minimum Enroute Altitude) ensuring the possibility of radiofrequency guidance along an aerial route culminating at a beacon, and
- minimum safe altitudes mentioned on the air maps such as the MORA (Minimum Off-Route Altitude) altitudes, whether they are of "route" type, that is, valid in the vicinity of an air route, ten nautical miles either side, or of "grid" type, that is, associated with a geographic locating grid having a mesh size measured in angle minutes in latitude and longitude that are stored in the cartographic part of the database 3.

When there are no MSA, MEA, route MORA and grid MORA minimum altitude values available in the database 3 for the geographic area being flown over, mainly in the polar ice cap regions, the end-of-conflict announcement function COT skips checking the observance of the minimum safe altitudes for want of being able to determine them.

Immediately there are MSA, MEA, route MORA or grid MORA minimum altitude values available in the cartographic part of the database 3 for the geographic area being flown over, the end-of-conflict announcement function COT proceeds to choose the minimum altitude values to be considered, a choice that it has depend on the apparent flight phase of the aircraft, namely:

- take-off or landing approach if the navigation instruments 4 on board indicate that the distance from the nearest airport is less than 21 Nm, the flight level less than 10 000 ft and the air speed less than 250 kts, climb to cruising altitude or descent for a landing approach if the navigation instruments 4 on board indicate either that the distance to the nearest airport is greater than 21 Nm, or that the air speed is greater than 250 kts, or even that the flight level is greater than 10 000 ft, and cruising, if the navigation instruments 4 on board indicate that the distance from the nearest airport is greater than 50 Nm or that the flight level is greater than 19 500 ft.

For a take-off or landing approach flight phase, the minimum safe altitude taken into consideration for a position given by the end-of-conflict announcement function COT is the highest out of the minimum regulatory altitude MSA and the grid MORA altitude applicable to this position.

For a climb or descent flight phase, the minimum safe altitude taken into consideration for a given position by the end-of-conflict announcement function COT is the highest out of the MSA minimum regulatory altitude, the grid MORA altitude and the route MORA altitude applicable to that position.

For a cruising flight phase, the minimum safe altitude taken into consideration for a given position by the end-of-conflict announcement function COT is the highest out of the MEA minimum regulatory altitude, the route MORA altitude and the grid MORA altitude applicable to that position.

The end-of-conflict announcement function COT checks the observance of a minimum safe altitude not only for the current position of the aircraft but also, the positions that it will occupy in a near future. To do this, the end-of-conflict announcement function COT extrapolates the path followed by the aircraft over a certain period, for example 20 seconds, assuming that it maintains the same turn radius (zero where appropriate), the same ground speed and the same vertical speed, determines in the way indicated previously minimum altitude values applicable to the current point and to the points of the extrapolated path and checks that these values are indeed observed, that is, that the flight levels reached by the aircraft in its current position and over the points of its extrapolated path are greater than the minimum altitude values taken into account.

Figure 4:
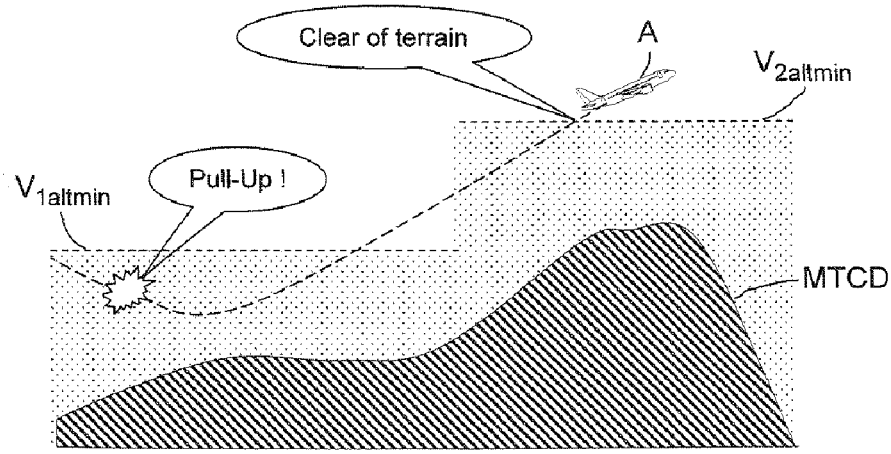
FIG. 4 is a view, in vertical cross section, of an avoidance path not always observing minimum safe altitude set points.

FIG. 4 illustrates an exemplary situation where the aircraft A, during a terrain avoidance maneuver, leaves an area with a minimum recognized altitude value $V1_{altmin}$ to enter into another area with a minimum recognized altitude value $V2_{altmin}$ that is significantly higher, passing, in the transition, through the range of intermediate values between the two values $V1_{altmin}$ and $V2_{altmin}$. The recognition of the positions occupied by the aircraft in a near future enables the end-of-conflict announcement function COT to avoid having the message generator 5 issue an end-of-conflict message when the observance by the aircraft of the minimum safe altitude is only transient.

The minimum safe distances relative to the terrain monitored by the end-of-conflict announcement function COT can concern a vertical safety margin. For this, the end-of-conflict announcement function COT applies the operating principle of the TAWS systems which involves checking that there is no intrusion, in a protection volume linked to the aircraft, of elements of the topographic representation of the relief of the area being flown over generated to implement the FLTA function for detecting risks of collision with the terrain. As in the TAWS system with assistance in returning to normal flight described in the U.S. Patent Publication No. 2006/052912, which is a U.S. counterpart of the French Patent Publication No. FR 2.848.661 and hereby incorporated by reference in its entirety, filed by the applicant, the protection volume used is an additional protection volume linked to the aircraft but the latter is configured for the sole aim of checking the existence of a minimum vertical safety margin below the aircraft.

Figure 5:
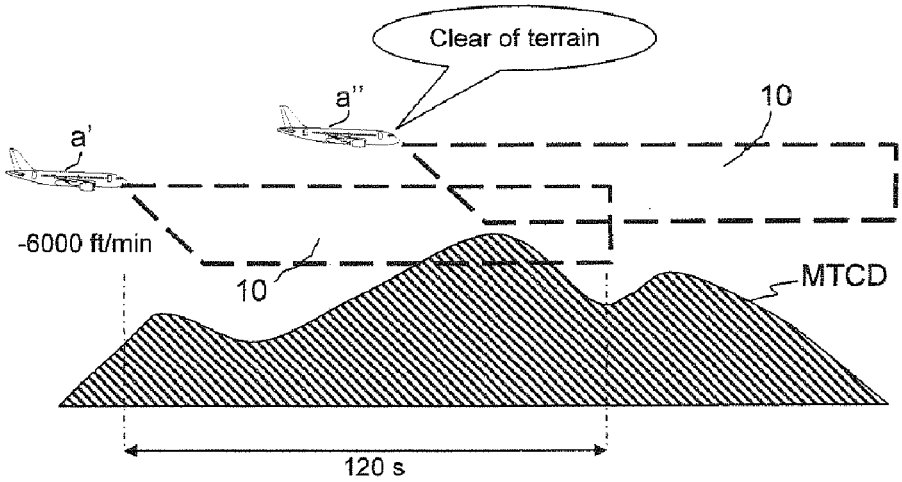
FIG. 5 is a view in vertical cross section illustrating the configuration of an additional protection volume dedicated to checking a vertical safe margin and implemented by the TAWS system according to the invention.

As shown in FIG. 5, the lower longitudinal profile of the additional vertical margin protection volume 10 corresponds to a potential leveling-off path that the aircraft would follow from its current position, over a short period, for example 120 seconds, if it was engaged, in its current position, in a steep descent, for example 6 000 ft/min, close to the limit allowed in normal operating conditions. The aircraft A is shown in two successive positions a' and a" during a vertical terrain avoidance maneuver executed to resolve a risk of collision with the terrain detected by the FLTA function, a first position a' in which the aircraft has not yet been able to recover a sufficient vertical margin, the additional vertical margin protection volume 10 intercepting the relief MTCD and a second position a" where the aircraft has finally been able to recover a sufficient vertical margin, the additional vertical margin protection volume no longer intercepting the MTCD relief.

The minimum safe distances relative to the terrain monitored by the end-of-conflict announcement function COT can also concern a lateral safety margin that is used to check that there is no more restriction on the lateral freedom of maneuver of the aircraft. For this, the end-of-conflict announcement function COT determines a minimum horizontal separation distance relative to the ground reliefs or obstacles reaching or exceeding the current flight level of the aircraft and checks that this minimum separation distance value is observed by the aircraft.

Figure 6:
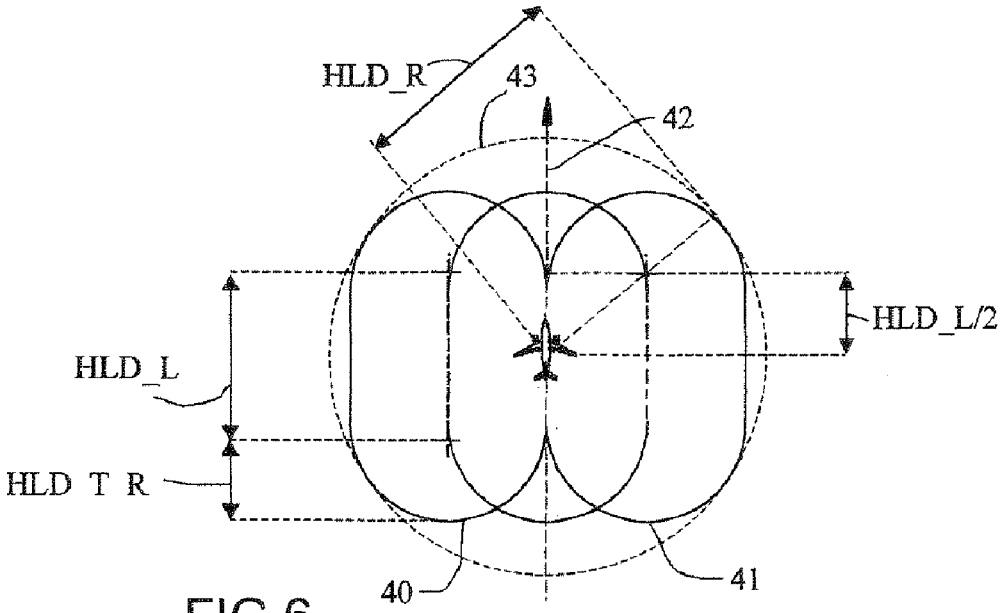
FIG. 6 illustrates a way of estimating the minimum width of the space needed by an aircraft for a free lateral maneuver implemented by the TAWS system according to the invention.

To determine the minimum horizontal separation distance value, the end-of-conflict announcement function COT estimates the radius of the horizontal area needed for the aircraft to describe a holding pattern, either side of its current path without modifying its current speed or being subjected when turning to mechanical stresses exceeding a certain tolerance threshold expressed by a limiting roll angle. As shown in FIG. 6, this radius is that of the circle circumscribed on the two possible paths 40, 41 for the holding pattern plus a safety margin.

The two possible paths 40, 41 for the holding pattern form two lobes tangential to the current route 42 of the aircraft. Each of them has two lengths HLD_L linked by two half-turns of radius HLD_T.

The value of the lengths HLD_L is a configuration data item defined as flight time or distance traveled on the ground. The value of the radius HLD_T of the half-turns assumed to be made flat, at constant ground speed GS and roll angle HLD_B, satisfies the relation:

$$\mathrm{HLD_T} = \frac{GS^2}{g \times \tan(\mathrm{HLD_B})}$$

the ground speed GS being data supplied by the aircraft instruments, HLD_B being a configuration data item calculated as a function of the theoretical performance characteristics of the aircraft and g being the acceleration of gravity.

The value of the radius HLD_R of the circle 43 circumscribed on the two possible paths 40, 41 for the holding pattern, satisfies the relation:

$$\mathrm{HLD_R} = \mathrm{HLD_T} + \sqrt{\left(\frac{\mathrm{HLD_L}}{2}\right)^2 + \mathrm{HLD_T}^2}$$

Ultimately, the value Sd of the minimum lateral margin adopted by the end-of-conflict announcement function satisfies the relation:

$$Sd = \text{HLD_M} + \text{HLD_T} + \sqrt{\left(\frac{\text{HLD_L}}{2}\right)^2 + \text{HLD_T}^2}$$

HLD_M being an additional safety margin relative to the radius HLD_R of the circle circumscribed on the two possible paths 40, 41 of the holding pattern.

To check observance of the value Sd adopted for the minimum lateral safety margin with regard to the relief and obstacles on the ground, the end-of-conflict announcement function COT uses the cartographic part of the database 3 to generate the map of the reliefs and obstacles of the region being flown over reaching or exceeding an altitude corresponding to the current flight level of the aircraft minus a vertical safety margin, for example 1 000 ft, and plots on this map iso-distance lines relative to the reliefs and obstacles, for example by using a propagation distance transform, as described by the applicant in French patent application FR 2.864.312.

Figure 7B:
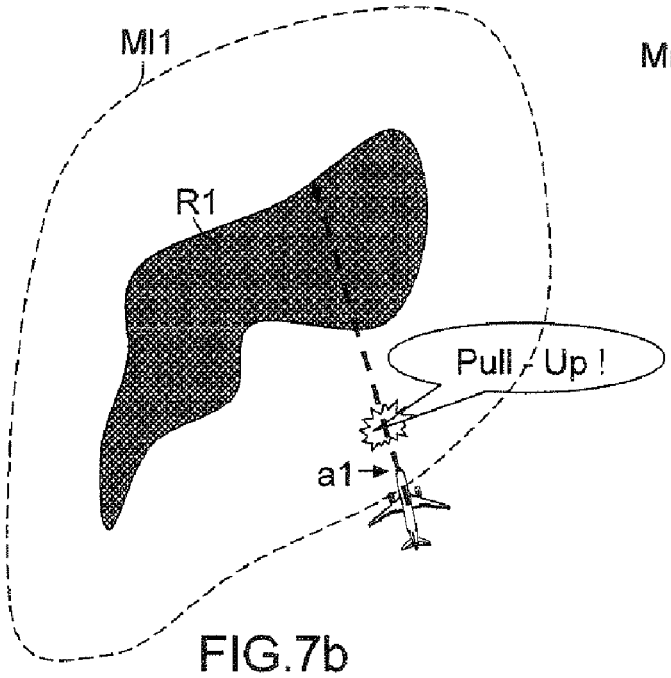
FIGS. 7*a*, 7*b* and 7*c* are horizontal and vertical cross sections showing an avoidance path and the way in which it observes a lateral safety margin.
Figure 7C:
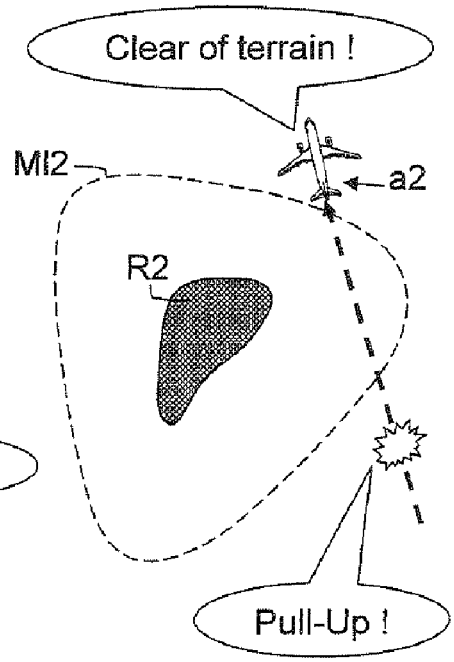
Figure 7A:
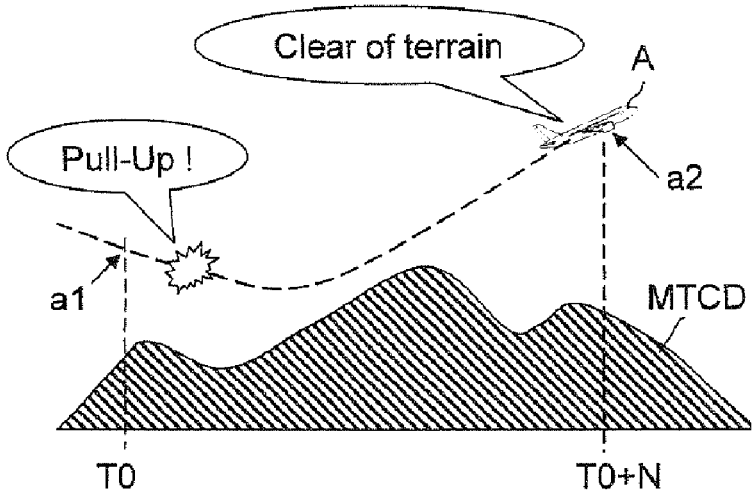

FIGS. 7*a*, 7*b* and 7*c* illustrate a case of vertical avoidance of the terrain where the Initial path of the aircraft having caused an alarm concerning risk of collision with the terrain ("Pull up") does not observe the minimum lateral margin.

As represented In the vertical cross section of FIG. 7*a*, the aircraft A executes a vertical terrain avoidance maneuver to clear a risk of collision with the terrain detected by the FLTA function, shortly after its passage through the position a1.

The horizontal cross section of FIG. 7*b* described at the flight level adopted by the aircraft A in the positional, shows that the aircraft A, when it passes the positional, is not observing the minimum lateral safety margin identified by the line MI1 surrounding the reliefs R1 reaching or exceeding the current altitude of the aircraft. The aircraft A therefore no longer has complete freedom of lateral maneuver in this positional, which, in itself, may seem normal to a crew whose aircraft is approaching a landing field in a mountainous area. The abnormal nature of the situation appears however to the crew because of the "Pull up" alarm message indicating a risk of collision with the ground which is immediately followed by the execution of a vertical terrain avoidance maneuver.

While the aircraft is climbing following the execution of the vertical avoidance maneuver, the reliefs reaching or exceeding the flight level of the aircraft become increasingly rare and present an increasingly small horizontal cross sectional area, reducing the risks of collision with the terrain accordingly. As shown in FIG. 7*c*, it is essential to wait for the avoidance path to be engaged beyond the position a2 for the altitude assumed by the aircraft to enable it ultimately to observe the minimum lateral margin identified by the line MI2 surrounding the relief R2 reaching or exceeding the current altitude of the aircraft.

The end-of-conflict announcement function COT, which is activated on each end of warning or alarm concerning the risk of collision with the terrain issued at the initiative of the FLTA function for detecting risks of collision with the terrain, proceeds to check the observance of safety minima for which it has a request to issue a "Clear of terrain" message depend, preferably, on:

a check on the observance of the minimum safe altitudes by the aircraft in its current position and In the positions that it will pass through in the short term (over 20 seconds) when such minimum altitudes have been able to be determined from the existence in the database 3 of minimum safe altitudes MSA, route MORA or grid MORA valid for the geographic positions concerned, a check on vertical margin, and/or a check on lateral margin.

When the check on the observance of the minimum safe altitudes cannot take place because there are no minimum altitudes that can be determined, the end-of-conflict announcement function COT proceeds with the two vertical and lateral margin checks. When the check on the observance of the minimum safe altitudes has been possible, the end-of-conflict announcement function COT can be satisfied with just the lateral margin check or carry out both vertical and lateral margin checks. Once the observance of the safety minima has been confirmed, the end-of-conflict announcement function COT generates its request to issue an end-of-conflict message ("Clear of terrain") to the message generator 5 and proceeds to determine the lower vertical speed margin.

To determine the lower vertical speed margin, the end-of-conflict announcement function COT takes up the principle of operation of the TAWS systems which consists in checking that there is no intrusion, within a protection volume linked to the aircraft, of elements of a topographic representation of the relief of the area being flown over. It acts as an additional protection volume linked to the aircraft, initially configured like that used by the FLTA function for the warnings concerning risk of collision with the terrain and distorted until it is penetrated by the topographic representation of the relief of the area being flown over.

Figure 8:
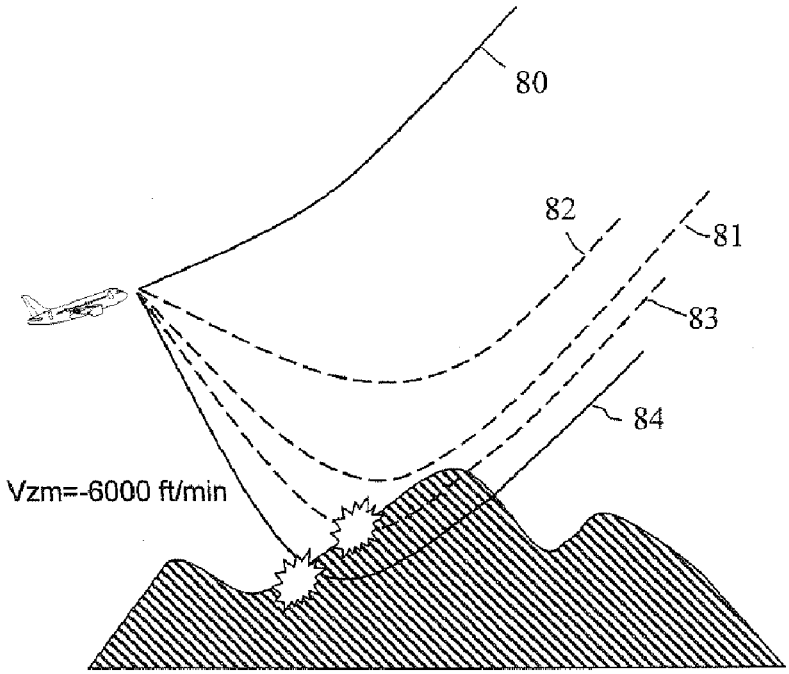
FIG. 8 is a view in vertical cross section illustrating a way of determining a lower vertical speed margin implemented by the TAWS system according to the invention.

As shown in FIG. 8, the configuration of the additional vertical speed margin protection volume is initially the same as that described in the introduction to the description, for the maneuver protection volume used for the warnings by the FTLA function with a lower longitudinal profile 80 corresponding to that of a potential path comprising as its first part an extrapolation of the path followed by the aircraft, as its second part a climb avoidance maneuver path with a gradient close to the maximum of the capabilities of the moment, undertaken over the prediction time, and, between the two parts, a transition path. During the process of determining the lower vertical speed margin, the lower longitudinal profile of the additional vertical speed margin protection volume is distorted by the adoption, in the first part, of an extrapolated path taking into consideration an increasingly pronounced downward vertical speed, making it increasingly distended until it is penetrated by the topographic representation of the relief of the area being flown over.

The distortion can be applied step by step by taking a unitary difference greater, for example, than 100 ft/min between two vertical speed values while considering only the vertical speed values greater than 6 000 ft/min. It can also be done by dichotomy by considering, during a first iteration, a lower longitudinal profile 81 corresponding to a vertical speed $V_{z1}$ taken to be equal to the current vertical speed of the aircraft $V_{z0}$ minus half of its difference with a vertical speed of $V_{zm}$ taken to be equal to −6 000 ft/min:

$$V_{z1}=(V_{z0}-V_{zm})/2$$

Then, either replace (profile 81) the vertical speed $V_{zm}$ with the vertical speed $V_{z1}$ if the topological representation of the terrain penetrates the lower longitudinal profile obtained, or replace (profile 81) the vertical speed $V_{z0}$ with the vertical speed $V_{z1}$ if the topological representation of the terrain does not penetrate the lower longitudinal profile obtained and recommence until the difference between two successive values $V_{zI}$, $V_{z(I+1)}$ does not exceed 100 ft/min.

The difference between the current vertical speed and the vertical speed reached when the topological representation of the relief penetrates into the additional distorted lower vertical speed margin protection volume gives the lower vertical speed margin that the aircraft cannot go beyond without once again triggering a warning or an alarm concerning collision with the terrain from the FTLA function. This margin is displayed on the onboard navigation screen in order to be taken into account by the crew in the maneuver to return to the path initially provided in the flight plan.

As a variant, the distortion of the additional lower vertical speed margin protection volume can be just a simple vertical pivoting downward of its lower longitudinal profile, performed around an origin linked to the aircraft.

The invention claimed is:

1. An onboard system for the prevention of collisions of an aircraft with a terrain, the system comprising:

a navigation instrument configured to transmit a plurality of flight parameters of the aircraft;

a database device configured to store cartographic data;

a message generator; and a computer coupled to the navigation instrument, database device, and the message generator, and configured to:

receive the flight parameters from the navigation instrument;

detect a risk of collision within a predetermined prediction period by detecting penetration of a topographic representation of the terrain being flown over generated based on the cartographic data into at least one maneuver protection volume associated with the aircraft;

instruct the message generator, if the risk of collision is detected, to generate a warning corresponding to the detected risk of collision;

determine if the aircraft is observing a minimum safe distance from the terrain being flown over;

calculate a vertical speed margin according to a vertical speed margin protection volume associate with the aircraft, the vertical speed margin protection volume having a lower longitudinal profile with a path that is extrapolated from a current path of the aircraft and tilted downward until the topographic representation of the terrain being flown over penetrates into the vertical speed margin protection volume; and instruct the message generator, after the generation of the warning corresponding to the detected risk of collision, an end of conflict message, with indication of the vertical speed margin indication.

2. The system according to claim 1, wherein the minimum safe distance is determined based on a flight phase of the aircraft that is defined as a function of a flight level of the aircraft, a speed of the aircraft, and a distance from the aircraft to an airport.

3. The system according to claim 1, wherein the computer is configured to determine if the aircraft is observing the minimum safe distance according to a current position of the aircraft and predicted positions extrapolated based on the flight parameters within a preset period.

4. The system according to claim 3, wherein the preset period is twenty seconds.

5. The system according to claim 1, wherein the lower longitudinal profile is determined based on a potential leveling-off path initiated from a current position of the aircraft with an estimated steep descent close to a limit allowable by the aircraft in normal operating conditions.

6. The system according to claim 5, wherein the vertical margin protection volume has a modeling lower surface profile on the leveling-off path over a period of two minutes.

7. The system according to claim 1, wherein the minimum safe distance is determined based on a lateral distance needed for the aircraft to describe a holding pattern.

8. The system according to claim 1, wherein the vertical speed margin protection volume has, initially, the same configuration as the at least one maneuver protection volume.

9. The system according to claim 1, wherein the vertical speed margin protection volume comprises a maneuver protection volume progressively tilted overall downward.

10. The system according to claim 1, wherein the lower longitudinal profile is determined by tilting the path downward, in successive steps and in a dichotomic manner, until the path is penetrated by the topographic representation of the terrain being flown over.

* * * * *